US012571163B2

(12) United States Patent
Katsuya et al.

(10) Patent No.: US 12,571,163 B2
(45) Date of Patent: Mar. 10, 2026

(54) SPACE FILLING MATERIAL, METHOD FOR MANUFACTURING SAME, AND SPACE FILLING STRUCTURE

(71) Applicant: KURARAY CO., LTD., Kurashiki (JP)

(72) Inventors: Satoshi Katsuya, Okayama (JP); Haruna Mitsumori, Okayama (JP); Ryokei Endo, Kurashiki (JP); Shohei Tsunofuri, Kurashiki (JP); Tsugumi Yoshida, Kurashiki (JP)

(73) Assignee: KURARAY CO., LTD., Kurashiki (JP)

( * ) Notice: Subject to any disclaimer, the term of this patent is extended or adjusted under 35 U.S.C. 154(b) by 281 days.

(21) Appl. No.: 18/118,170

(22) Filed: Mar. 7, 2023

(65) Prior Publication Data

US 2023/0228035 A1 Jul. 20, 2023

Related U.S. Application Data

(63) Continuation of application No. PCT/JP2021/031888, filed on Aug. 31, 2021.

(30) Foreign Application Priority Data

Sep. 8, 2020 (JP) ..... 2020-150807

(51) Int. Cl.
*B32B 5/02* (2006.01)
*B29C 35/02* (2006.01)
(Continued)

(52) U.S. Cl.
CPC ..... *D21H 13/20* (2013.01); *D04H 1/4218* (2013.01); *D04H 1/5418* (2020.05); *D04H 1/55* (2013.01);
(Continued)

(58) Field of Classification Search
CPC ..... B32B 5/266; B32B 5/022; B32B 5/12; B32B 2260/021; B32B 2260/046;
(Continued)

(56) References Cited

U.S. PATENT DOCUMENTS

2016/0339669 A1 11/2016 Miyoshi et al.
2019/0040245 A1* 2/2019 Sakurai ..... C08K 5/34922
(Continued)

FOREIGN PATENT DOCUMENTS

CN 111164133 A 5/2020
CN 111417674 A 7/2020
(Continued)

OTHER PUBLICATIONS

English translation of the International Preliminary Report on Patentability and Written Opinion issued Mar. 23, 2023 in PCT/JP2021/031888, 6 pages.
(Continued)

*Primary Examiner* — Joanna Pleszczynska
(74) *Attorney, Agent, or Firm* — Element IP, PLC

(57) ABSTRACT

Provided is a space filling material having excellent strength in reinforcing a predetermined space to be filled with the space filling material and/or strength in fixing a material to be fixed therewith. The space filling material (11) includes reinforcing fibers and a thermoplastic resin, wherein the reinforcing fibers form a plurality of intersections at least a part of which are bonded with the thermoplastic resin, and among all of the reinforcing fibers, a proportion in volume of reinforcing fibers each having a bent ratio of 1.004 or higher is 20 vol % or more relative to a total volume of the reinforcing fibers, the bent ratio being defined as a ratio of fiber length/shortest distance between opposite ends of fiber. The space filling material (11) expands to fill a predeter-
(Continued)

mined space (13) when the thermoplastic resin is softened by heating to release bending loads of the reinforcing fibers.

13 Claims, 3 Drawing Sheets

(51) Int. Cl.

| | |
|---|---|
| ***B32B 5/12*** | (2006.01) |
| ***B32B 5/26*** | (2006.01) |
| ***D04H 1/4209*** | (2012.01) |
| ***D04H 1/4218*** | (2012.01) |
| ***D04H 1/4242*** | (2012.01) |
| ***D04H 1/541*** | (2012.01) |
| ***D04H 1/55*** | (2012.01) |
| ***D04H 1/587*** | (2012.01) |
| ***D04H 1/732*** | (2012.01) |
| ***D21H 13/20*** | (2006.01) |
| ***D21H 13/36*** | (2006.01) |
| ***D21H 13/40*** | (2006.01) |

(52) U.S. Cl.
CPC ..... *D04H 1/587* (2013.01); *D04H 1/732* (2013.01); *D21H 13/40* (2013.01)

(58) Field of Classification Search
CPC .. D04H 1/4218; D04H 1/4209; D04H 1/4242; D04H 1/4342; D21H 13/40; D21H 13/50; D21H 13/36
See application file for complete search history.

(56) References Cited

U.S. PATENT DOCUMENTS

| | | | |
|---|---|---|---|
| 2020/0224345 | A1 | 7/2020 | Katsuya et al. |
| 2020/0277456 | A1 | 9/2020 | Katsuya et al. |

FOREIGN PATENT DOCUMENTS

| | | | |
|---|---|---|---|
| JP | 05023406 | A | 2/1993 |
| JP | 2003262116 | A | 9/2003 |
| JP | 2006149059 | A | 6/2006 |
| JP | 2009228952 | A | 10/2009 |
| JP | 2019137965 | A | 8/2019 |
| WO | WO-2015108021 | A1 | 7/2015 |
| WO | WO-2018117187 | A1 | 6/2018 |
| WO | WO-2019107343 | A1 | 6/2019 |

OTHER PUBLICATIONS

"Nonwovens", Ke Qinfei et al., Donghua University Press, 3rd edition, Aug. 2016, pp. 242-343 (with English machine translation), 9 total pages.
Office Action issued Sep. 24, 2024, in corresponding Japanese Patent Application No. 2022-547515 (with machine English translation), 21 pages.
Extended European Search Report issued Jul. 29, 2024, in corresponding European Patent Application No. 21866598.2, 9 pages.
International Search Report issued Nov. 22, 2021 in PCT/JP2021/031888 (with English translation), 4 pages.

* cited by examiner

SPACE FILLING MATERIAL, METHOD FOR MANUFACTURING SAME, AND SPACE FILLING STRUCTURE

CROSS REFERENCE TO THE RELATED APPLICATION

This application is a continuation application, under 35 U.S.C § 111(a) of international application No. PCT/JP2021/031888, filed Aug. 31, 2021, which claims priority to Japanese patent application No. 2020-150807, filed Sep. 8, 2020, the entire disclosures of all of which are herein incorporated by reference as a part of this application.

FIELD OF THE INVENTION

The present invention relates to a space filling material which fills a predetermined space when heated and a method for manufacturing the same, as well as a space filling structure comprising such a space filling material.

BACKGROUND OF THE INVENTION

A composite material which expands when heated and functions as a sealing material has been conventionally known. For example, Patent Document 1 (JP Laid-open Patent Publication No. 2003-262116) discloses a sealing material for a catalytic converter for purifying automobile exhaust gas, the sealing material being a sheet-shaped molded body which comprises inorganic short fibers and an organic binder, and is obtained from a slurry including the inorganic short fibers and the organic binder using a paper-making method, or by spraying the organic binder onto sheet-shaped inorganic short fibers to be integrated thereto, wherein the sealing material is capable of expanding to 1.3 to 6 times in the thickness direction of the molded body upon heating which leads to decomposition of the organic binder and generation of a restoring surface pressure due to the inorganic short fibers.

SUMMARY OF THE INVENTION

However, since the sealing material of Patent Document 1 is expansive only after the organic binder is decomposed in pyrolysis so as to make the shapes of the inorganic short fibers to be restored, the sealing material can neither take advantage of characteristics of the organic binder itself nor provide sufficient pressing force for sealing due to utilization of the inorganic short fibers alone. In addition, decomposition of the organic binder in pyrolysis produces a large amount of decomposition gas, which needs to be discharged out of the system.

Therefore, an object of the present invention is to provide a space filling material which solves such problems of the conventional technology and can impart excellent reinforcing strength to a predetermined space to be filled with the space filling material as well as is excellent in strength for fixing a material to be fixed therewith.

The inventors of the present invention have conducted intensive studies to solve the above problems and have found that in production of a space filling material comprising reinforcing fibers and a thermoplastic resin in a state that the reinforcing fibers form a plurality of intersections at least a part of which are bonded with the thermoplastic resin, adjustment of a composite sheet which is a precursor material for the space filling material to have a specific property and/or determination of hot pressing condition to produce the space filling material make it possible to obtain a space filling material containing a specific amount of reinforcing fibers each having a specific bent ratio. The inventors then have found that such a space filling material imparts excellent strength in reinforcing a predetermined space to be filled with the space filling material and is excellent in strength for fixing a material to be fixed therewith because the reinforcing fibers provide a very large repulsive force when the thermoplastic resin is softened to release bending loads of the reinforcing fibers. The present invention was thus achieved.

That is, the present invention may include the following aspects.

Aspect 1

A space filling material comprising reinforcing fibers and a thermoplastic resin, wherein the reinforcing fibers form a plurality of intersections (cross-over points) at least a part of which are bonded with the thermoplastic resin, and among all of the reinforcing fibers, a proportion in volume of reinforcing fibers each having a bent ratio (curl ratio) represented by the following formula (1) of 1.004 or higher is 20 vol % or more (preferably 30 vol % or more, more preferably 35 vol % or more, and further preferably 40 vol % or more) relative to a total volume of the reinforcing fibers, $$\text{Bent Ratio}=\text{Fiber Length}/\text{Shortest Distance Between Opposite Ends of Fiber} \quad (1).$$

Aspect 2

The space filling material according to aspect 1, wherein the space filling material has a CV (coefficient of variation) value of thickness of 0.2 or smaller (preferably 0.1 or smaller, more preferably 0.08 or smaller, and further preferably 0.06 or smaller).

Aspect 3

The space filling material according to aspect 1 or 2, wherein the space filling material has an average thickness of from 10 to 1000 μm (preferably 20 to 500 μm, and more preferably 50 to 300 μm).

Aspect 4

The space filling material according to any one of aspects 1 to 3, wherein a release (loosening) rate of the bent ratio is 20% or higher (preferably 30% or higher, more preferably 40% or higher, further preferably 50% or higher, and still more preferably 60% or higher), the release rate of the bent ratio being defined by the following formula (2):

$$\text{Release Rate of Bent Ratio (\%)}=[(X-1)-(Y-1)]/(X-1)\times 100 \quad (2)$$

in which X is an average bent ratio of reinforcing fibers in a space filling material before expansion, and Y is an average bent ratio of reinforcing fibers in a space filling material after being heated to expand without pressurization.

Aspect 5

The space filling material according to any one of aspects 1 to 4, wherein the space filling material has a CV value of basis weight of 0.2 or smaller (preferably 0.15 or smaller, and more preferably 0.1 or smaller).

Aspect 6

The space filling material according to any one of aspects 1 to 5, wherein the reinforcing fibers have an average fiber length of from 3 to 100 mm (preferably 4 to 80 mm, and more preferably 5 to 50 mm).

Aspect 7

The space filling material according to any one of aspects 1 to 6, wherein a volume content of the reinforcing fibers each having the bent ratio of 1.004 or higher is from 3 to 50 vol % (preferably 5 to 45 vol %, and more preferably 10 to 40 vol %) relative to a total volume of the space filling material.

Aspect 8

The space filling material according to any one of aspects 1 to 7, wherein a weight content of the thermoplastic resin is from 40 to 85 wt % (preferably 45 to 82 wt %, more preferably 50 to 80 wt %, and further preferably 52 to 75 wt %) relative to a total weight of the space filling material.

Aspect 9

A space filling structure comprising the space filling material as recited in any one of aspects 1 to 8, and a material to be fixed which is integrated in contact with at least a part of the space filling material.

Aspect 10

A method for producing the space filling material as recited in any one of aspects 1 to 8, the method at least comprising:

preparing a composite sheet containing reinforcing fibers and a thermoplastic resin;

heating the composite sheet at a temperature equal to or higher than a softening point of the thermoplastic resin and applying pressure to the composite sheet in a thickness direction to perform hot-pressing; and cooling the hot-pressed composite sheet to a temperature lower than the softening point of the thermoplastic resin while applying the pressure.

Aspect 11

The method according to aspect 10, wherein the composite sheet is a mixed paper containing the reinforcing fibers and thermoplastic fibers.

Aspect 12

The method according to aspect 11, wherein the mixed paper is made from an aqueous slurry containing the reinforcing fibers, the thermoplastic fibers, and a dispersant.

Aspect 13

The method according to aspect 12, wherein the aqueous slurry further contains a thickener.

The present invention encompasses any combination of at least two features disclosed in the claims and/or the specification and/or the drawings. In particular, any combination of two or more of the appended claims should be equally construed as included within the scope of the present invention.

The space filling material according to the present invention can impart excellent strength in reinforcing a predetermined space to be filled with the space filling material and/or strength in fixing a material to be fixed therewith.

BRIEF DESCRIPTION OF THE DRAWINGS

The present invention will be more clearly understood from the following description of preferred embodiments thereof, when taken in conjunction with the accompanying drawings. The drawings are not necessarily shown at a consistent scale and may be exaggerated in order to illustrate the principle according to the present invention. However, the embodiments and the drawings are given only for the purpose of illustration and explanation, and are not to be taken as limiting the scope of the present invention in any way whatsoever, which scope is to be determined by the appended claims. In the figures.

DESCRIPTION OF THE EMBODIMENTS

Method for Producing Space Filling Material

Figure 1:
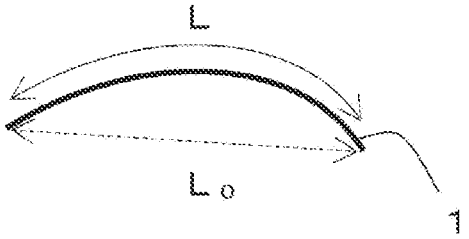
FIG. 1 is a schematic diagram for illustrating a bent ratio of a reinforcing fiber.

The method for producing a space filling material according to the present invention may at least comprise steps of: preparing a composite sheet containing reinforcing fibers and a thermoplastic resin; heating the composite sheet at a temperature equal to or higher than a softening point of the thermoplastic resin and applying pressure to the composite sheet in a thickness direction to perform hot-pressing; and cooling the hot-pressed composite sheet to a temperature lower than the softening point of the thermoplastic resin while applying the pressure. In order to produce a space filling material containing a specific amount of reinforcing fibers each having a specific bent ratio, the later-described production conditions should be appropriately adjusted depending on the desired basis weight, thickness, etc. of the space filling material. For example, the proportion of the reinforcing fibers in the composite sheet, the number of composite sheets to be hot-pressed, and/or the conditions of the hot-pressing step can be appropriately changed to adjust the bent ratios of the reinforcing fibers.

The composite sheet is a material which contains reinforcing fibers and a thermoplastic resin and can be formed into a space filling material through the hot-pressing step and the cooling step. The composite sheet may take various forms. Examples of the composite sheet may include: a mixed nonwoven fabric containing reinforcing fibers and thermoplastic fibers, and a nonwoven fabric containing reinforcing fibers and a particulate (or powdery) thermoplastic resin dispersed in the nonwoven fabric. Preferably, the composite sheet may be a mixed nonwoven fabric containing reinforcing fibers and thermoplastic fibers. More preferably, in terms of uniformity in distribution of reinforcing fibers and thermoplastic fibers, the composite sheet may be a wet-laid nonwoven fabric (for example, mixed paper; hereinafter, a mixed nonwoven fabric produced by wet-laid papermaking is called as mixed paper) containing reinforcing fibers and thermoplastic fibers.

The reinforcing fibers used in the present invention are not particularly limited to specific ones as long as the effects of the present invention are not impaired. The reinforcing fibers may be organic fibers or inorganic fibers. The reinforcing fibers may be used singly or in combination of two or more. Examples of inorganic fibers may include: glass fibers, carbon fibers, various ceramic fibers (e.g., silicon carbide fibers, silicon nitride fibers, silica fibers, alumina fibers, zirconia fibers, boron fibers, basalt fibers, etc.), various metal fibers (e.g., fibers of gold, silver, copper, iron, nickel, titanium, stainless steel, etc.) and the like. The organic fibers are not particularly limited to specific ones as long as the fibers have a glass transition temperature or a melting point higher than a softening point of the thermoplastic resin for bonding the intersections of the reinforcing fibers. Examples of the organic fibers may include: wholly-aromatic polyester-based fibers, polyphenylene sulfide-based fibers, para-aramid-based fibers, polysulfonamide-based fibers, phenolic resin-based fibers, polyimide-based fibers, fluorine-containing resin-based fibers and the like. In the present invention, the softening point mainly means a thermal deformation temperature of the thermoplastic resin and may be, for example, the deflection temperature under load (JIS K 7207). In particular, in the case of an amorphous resin, the term means a glass transition temperature thereof.

Of these, from the viewpoint of increasing the repulsive force of the reinforcing fibers, it is preferable to use inorganic fibers having high elastic modulus such as glass fibers or carbon fibers. For the applications which require insulation in a structure containing an expanded space filling material, insulating fibers (e.g., glass fibers, silicon nitride fibers, silica fibers, alumina fibers) may be used.

The reinforcing fibers used in the present invention may be preferably discontinuous fibers, and the discontinuous fibers may have an average fiber length of preferably from 3 to 100 mm, from the viewpoint of increasing the repulsive force of the reinforcing fibers. The average fiber length may be more preferably from 4 to 80 mm, and further preferably from 5 to 50 mm. The average fiber length is a value determined by the method described in Examples below.

The reinforcing fibers used in the present invention may preferably have an average single fiber diameter of from 2 to 40 μm, from the viewpoint of increasing the repulsive force of the reinforcing fibers. The average fiber diameter may be more preferably from 3 to 30 μm, and further preferably from 4 to 20 μm. The average fiber diameter is a value determined by the method described in Examples below.

The reinforcing fibers used in the present invention may preferably have a single fiber aspect ratio (average fiber length/average fiber diameter) of from 100 to 50000, from the viewpoint of increasing the repulsive force of the reinforcing fibers. The single fiber aspect ratio may be more preferably from 300 to 10000, and further preferably from 500 to 5000.

The reinforcing fibers used in the present invention may preferably have a tensile elastic modulus of 10 GPa or higher, from the viewpoint of increasing the repulsive force of the reinforcing fibers. The tensile elastic modulus may be more preferably 30 GPa or higher, and further preferably 50 GPa or higher. The upper limit thereof is not particularly limited to a specific one and may be 1000 GPa or lower. The tensile elastic modulus can be measured by a method conforming to the respective standards suitable for each type of fibers, such as JIS R 7606 for carbon fibers, JIS R 3420 for glass fibers, and JIS L 1013 for organic fibers.

From the viewpoint of adjusting the bent ratios of the reinforcing fibers in the space filling material to be obtained, a weight content of the reinforcing fibers may be from 15 to 60% by weight (wt %), preferably from 18 to 55 wt %, more preferably from 20 to 50 wt %, and further preferably 25 to 48 wt % relative to a total weight of the composite sheet. Where the content of the reinforcing fibers is too low, the reinforcing fibers have less contact with one another, so that the reinforcing fibers are less likely to be bent (curled). On the other hand, where the content of the reinforcing fibers is too high, the thermoplastic resin is contained in a small amount, and the reinforcing fibers thus cannot be held in a bent state, so that it tends to be difficult to adjust the bent ratios of the reinforcing fibers.

Examples of the thermoplastic resin used in the present invention may include: a vinyl-based resin (a polymer synthesized from monomers having a vinyl group $CH_2{=}CH{-}$ or a vinylidene group $CH_2{=}C<$ or a derivative thereof); a polyamide-based resin such as an aliphatic polyamide-based resin (polyamide 6, polyamide 66, polyamide 11, polyamide 12, polyamide 610, polyamide 612, etc.), a semi-aromatic polyamide-based resin and a wholly-aromatic polyamide-based resin; a polyester-based resin such as polyethylene terephthalate, polytrimethylene terephthalate, polybutylene terephthalate, and polyethylene naphthalate; a fluorine-containing resin such as a polytetrafluoroethylene-based resin; a thermoplastic polyimide-based resin such as a semi-aromatic polyimide-based resin, a polyamideimide-based resin, and a polyetherimide-based resin; a polysulfone-based resin such as a polysulfone-based resin and a polyethersulfone-based resin; a modified polyphenylene ether-based resin; a polyether ketone-based resin such as a polyether ketone-based resin, a polyether ether ketone-based resin, and a polyether ketone ketone-based resin; a polycarbonate-based resin; an amorphous polyarylate-based resin; a liquid crystal polyester-based resin such as a wholly-aromatic polyester-based resin; a thermoplastic elastomer such as a urethane-based elastomer, a styrene-based elastomer, an olefin-based elastomer, a vinyl chloride-based elastomer, an ester-based elastomer, and an amide-based elastomer; and others. These thermoplastic resins may be used singly or in combination of two or more.

The thermoplastic resin used in the present invention may be preferably a thermoplastic resin having a glass transition temperature of 100° C. or higher, for applications which require heat resistance in a structure containing an expanded space filling material. Examples of the thermoplastic resins having a glass transition temperature of 100° C. or higher may include: a polytetrafluoroethylene-based resin, a thermoplastic polyimide-based resin, a polysulfone-based resin, a semi-aromatic polyamide-based resin, a polyether ketone-based resin, a polycarbonate-based resin, a liquid crystal polyester-based resin, and the like. Of these, in terms of mechanical properties and moldability, the thermoplastic resin may be at least one thermoplastic resin selected from the group consisting of a thermoplastic polyimide-based resin (preferably a polyetherimide-based resin), a polyether ketone-based resin (preferably a polyether ether ketone-based resin), a semi-aromatic polyamide-based resin, a polycarbonate-based resin, and a polysulfone-based resin. For applications which require heat resistance, the thermoplastic resin may have a glass transition temperature of preferably 105° C. or higher, and more preferably 110° C. or higher. The upper limit thereof is not particularly limited to a specific one and may be 300° C. or lower, from the viewpoint of economical use of the space filling material. The glass transition temperature is a value determined by the method described in Examples below.

The thermoplastic resin used in the present invention may contain various additives as long as the effects of the present invention are not impaired.

Where a mixed nonwoven fabric is used as the composite sheet, thermoplastic fibers obtained by fiberizing the above thermoplastic resin by a known method can be used. From the viewpoint of adjusting the bent ratios of the reinforcing fibers in the space filling material to be obtained, the mixed nonwoven fabric used in the present invention may have a weight content of the thermoplastic fibers of from 40 to 85 wt %, preferably from 45 to 82 wt %, more preferably from 50 to 80 wt %, and further preferably from 52 to 75 wt % relative to a total weight of the mixed nonwoven fabric.

The thermoplastic fibers may preferably have a single fiber fineness of from 0.1 to 20 dtex, from the viewpoint of enhancing the dispersibility of the reinforcing fibers. In order to obtain a space filling material which provides excellent expansion stress when heated, it is desirable that the reinforcing fibers are uniformly dispersed in the mixed nonwoven fabric. The single fiber fineness of the thermoplastic fibers may be more preferably from 0.5 to 18 dtex, and further preferably from 1 to 16 dtex. The single fiber fineness is a value measured by the method described in Examples below.

From the viewpoint of enhancing the dispersibility of the reinforcing fibers, the thermoplastic fibers may have an average fiber length of preferably from 0.5 to 60 mm, more preferably from 1 to 55 mm, and further preferably from 3 to 50 mm. The average fiber length is a value determined by the method described in Examples below. The cross-sectional shape of the fibers is not particularly limited to a specific one and may be circular, hollow, flat, or modified cross-sectional shape such as a star shape.

Where fibers made of a thermoplastic resin having a glass transition temperature of 100° C. or higher are used as the thermoplastic fibers, the mixed nonwoven fabric may contain a binder component as needed. The weight content of the binder component relative to the mixed nonwoven fabric may be, for example, 10 wt % or less. The shape of the binder component may be fibrous, particulate, liquid, or the like. From the viewpoint of forming a nonwoven fabric, binder fibers are preferable. The binder component is not particularly limited to a specific one, and examples thereof may include a polyolefin-based resin, a polyamide-based resin, a polyester-based resin, an acrylic-based resin, a polyvinyl alcohol-based resin, and a polyurethane-based resin. Of these, a polyester-based resin is preferred. These binder components correspond to the components that constitute the thermoplastic resin of the space filling material to be obtained. From the viewpoint that the binder component constitutes a part of the matrix as the thermoplastic resin, it is preferable to use a binder component compatible with the thermoplastic fibers. In this case, the resulting space filling material has excellent strength because the matrix is unified.

The polyester-based resin may comprise a polyester-based polymer containing a terephthalic acid component (a) and an isophthalic acid component (b), of dicarboxylic acid components, at a copolymerization ratio (molar ratio) of (a)/(b)=100/0 to 40/60 (preferably 99/1 to 40/60). Use of such a polyester-based resin makes it possible to improve the strength of the mixed nonwoven fabric thanks to the good binder properties, providing excellent processability and suppressing thermal decomposition during forming at high temperature. In addition, such a polyester-based resin is compatible with a thermoplastic polyimide-based resin (preferably a polyetherimide-based resin) and therefore, is particularly preferred as the binder component in the case where thermoplastic fibers made of a polyimide-based resin are used. The copolymerization ratio may be more preferably (a)/(b)=90/10 to 45/55, and further preferably (a)/(b) =85/15 to 50/50.

The polyester-based resin may contain a small amount (for example, 5 mol % or less) of one or more dicarboxylic acid components other than terephthalic acid and isophthalic acid in combination with these components as long as the effects of the present invention are not impaired.

The diol component that constitutes the polyester-based resin may be ethylene glycol. The polyester resin may contain a small amount (for example, 5 mol % or less) of one or more diol components other than ethylene glycol.

The method for producing the nonwoven fabric is not particularly limited to a specific one, and examples of the method may include: spunlacing, needle punching, steam jetting, dry-laid papermaking, wet-laid papermaking (wet-laid process), and others. Of these, wet-laid papermaking is preferable in terms of production efficiency and uniform dispersion of the reinforcing fibers in the nonwoven fabric. For example, in wet-laid papermaking, an aqueous slurry containing thermoplastic fibers and reinforcing fibers may be prepared, and then the slurry may be used in a typical papermaking process. It should be noted that the aqueous slurry may also contain the above-mentioned binder fibers (for example, water-soluble polymer fibers such as polyvinyl alcohol-based fibers, heat-fusible fibers such as polyester-based fibers) as needed. In order to improve uniformity of the nonwoven fabric and bonding of the nonwoven fabric under pressure, a binder component may be applied by spray drying, or a hot-pressing step may be added after the wet-laid papermaking step.

In the case of wet-laid papermaking, from the viewpoint of enhancing uniformity in thickness and/or basis weight of the space filling material to be obtained, an aqueous slurry further containing a dispersant may be used. The dispersant can be a known dispersant capable of dispersing reinforcing fibers and thermoplastic fibers in water, and examples of the dispersant may include: a polymeric dispersant such as a polyalkylene oxide-based dispersant, a polyacrylamide-based dispersant, a polyacrylic acid-based dispersant, and a urethan resin-based dispersant.

From the viewpoint of enhancing uniformity in thickness and/or basis weight of the space filling material to be obtained, an aqueous slurry further containing a thickener may be used. Examples of the thickener may include: an anionic polyacrylamide, a nonionic polyethylene oxide, and the like. Of these, an anionic polyacrylamide is preferably used as the thickener. This is because addition of a cationic compound more easily leads to obtaining fiber blend bundles.

The basis weight of the nonwoven fabric is not particularly limited to a specific one and may be preferably from 5 to 1500 g/m$^2$. The basis weight may be more preferably from 10 to 1000 g/m$^2$, and further preferably from 20 to 500 g/m$^2$.

In the hot-pressing step, the composite sheet may be heated at a temperature equal to or higher than the softening point of the thermoplastic resin while applying pressure in the thickness direction to perform hot-pressing. By applying a certain condition of heat and pressure in the thickness direction, the reinforcing fibers can be bent because compression of the reinforcing fibers occurs in contact with one another. In the present invention, the bent ratios of the reinforcing fibers can be adjusted by changing the conditions of hot pressing described later depending on the contents of the reinforcing fibers and the thermoplastic resin in the composite sheet, the basis weight of the composite sheet, and/or the number of the composite sheets to be hot-pressed.

The method of hot pressing is not particularly limited to a specific one, and general compression molding such as stampable molding, pressure molding, vacuum compression molding, and GMT molding may be preferably used. The molding temperature in this process may be set depending on the softening point and/or the decomposition temperature of the thermoplastic resin to be used. The heating temperature is preferably equal to or higher than the softening point of the thermoplastic resin. For example, in the case where the thermoplastic resin is crystalline, the heating temperature is preferably in the range of from the melting point of the thermoplastic resin to a temperature of (melting point+100)° C. In the case where the thermoplastic resin is amorphous, the heating temperature is preferably in the range of from the glass transition temperature of the thermoplastic resin to a temperature of (glass transition temperature+200)° C. If necessary, the composite sheet may be preheated using an IR heater or the like before hot pressing.

The pressure for hot pressing is not particularly limited to a specific one and is typically 0.05 MPa or higher. The pressure may be more preferably 0.1 MPa or higher, and further preferably 0.5 MPa or higher. The upper limit thereof is not particularly limited and may be about 30 MPa. The time for hot pressing is not also particularly limited to a specific one, and may be usually preferably within 30 minutes, more preferably within 25 minutes, and further preferably within 20 minutes since the thermoplastic resin could be deteriorated when exposed to high temperature for a long time. The lower limit is not particularly limited and may be about 1 minute.

In the hot-pressing step, one or a plurality of the composite sheets stacked can be subjected to hot pressing. Although the preferable conditions can vary depending on, for example, the basis weight of the composite sheet and/or the desired thickness of the space filling material, a stacked body including a plurality of the composite sheets (for example, 2 to 100 sheets, and preferably 3 to 50 sheets) may be subjected to hot pressing from the viewpoint of adjusting the bent ratios of the reinforcing fibers.

In addition, the type of reinforcing fibers and the pressure to be applied can be appropriately set in order to adjust the thickness and the density of the space filling material to be obtained. Furthermore, the shape of the space filling material to be obtained is not particularly limited to a specific one and can be set as appropriate. Depending on the intended use, two or more mixed nonwoven fabrics and the like with different embodiments may be stacked and hot-pressed. Alternatively, two or more mixed nonwoven fabrics and the like with different embodiments may be arranged separately in a mold having a certain size.

In the cooling step, the composite sheet is cooled to a temperature lower than the softening point of the thermoplastic resin with the pressure in the hot-pressing step maintained, so as to give a space filling material having a predetermined shape. Cooling under pressure makes it possible to maintain the state of the reinforcing fibers adjusted to a specific bent ratio in the hot-pressing step as described above, and thereby to obtain a space filling material having a specific amount of reinforcing fibers each having a specific bent ratio.

Space Filling Material

The space filling material according to the present invention comprises reinforcing fibers and a thermoplastic resin. The space filling material may contain a substance(s) other than the reinforcing fibers and the thermoplastic resin, as long as the effects of the present invention are not impaired. The reinforcing fibers form a plurality of intersections at least a part of which are bonded with the thermoplastic resin. For example, the reinforcing fibers in a randomly oriented state may form a plurality of intersections at least a part of which may be bonded with the thermoplastic resin. Preferably, the thermoplastic resin may form a webbed (flippered) shape around the intersections of the reinforcing fibers, or may form a matrix embedding the reinforcing fibers. Such a structure improves the structural strength of the space filling material.

In the space filling material according to the present invention, a volume content of reinforcing fibers each having a bent ratio of 1.004 or higher is 20 vol % or more relative to a total volume of the reinforcing fibers, the bent ratio being defined by the following formula (1):

$$\text{Bent Ratio} = \text{Fiber Length}/\text{Shortest Distance Between Opposite Ends of Fiber} \quad (1).$$

FIG. 1 is a schematic diagram for illustrating a bent ratio of a reinforcing fiber. As shown in FIG. 1, the reinforcing fiber is assumed to have an arched shape centered at a substantially central part thereof in the space filling material. In this case, the fiber length in the above formula (1) indicates the length L along the curved shape of the fiber, and the shortest distance between opposite ends of the fiber indicates the length $L_0$ of the straight line connecting two points at the opposite ends of the fiber. It should be noted that the shape of the bent reinforcing fiber is not limited to the arched shape as shown in FIG. 1 and may be a chevron shape or a wave shape.

In the present invention, it has been found that the residual stress due to the bending of the reinforcing fibers contributes to the expansion of the space filling material upon flowing of the thermoplastic resin, that the reinforcing fibers each having the bent ratio of 1.004 or higher provide a large repulsive force, and that a space filling material including a specific proportion of reinforcing fibers in such a state can provide improved strength in reinforcing a predetermined space as well as improved strength in fixing a material to be fixed when the space is filled with the space filling material. In the space filling material according to the present invention, the volume content of the reinforcing fibers each having a bent ratio of 1.004 or higher may be preferably 30 vol % or more, more preferably 35 vol % or more, and further preferably 40 vol % or more relative to the total volume of the reinforcing fibers. The upper limit of the volume content of reinforcing fibers each having a bent ratio of 1.004 or higher relative to the total volume of the reinforcing fibers is not particularly limited to a specific one and may be, for example, 100 vol %. The bent ratios of the reinforcing fibers are a value determined by the method described in Examples below.

In the space filling material according to the present invention, reinforcing fibers can exhibit, when the space filling material is heated in a predetermined space, a repulsive force (restoring force) as the thermoplastic resin matrix surrounding the reinforcing fibers flows to release bending loads of the reinforcing fibers to restore straight state of the reinforcing fibers. As a result, the space filling material can expand and generate expansion stress on an external member and the like so that the space filling material is capable of filling a space at least in the thickness direction of the space filling material. The space filling material according to the present invention can apply a high pressing force to the external member due to the expansion stress of the space filling material and, at the same time, can exhibit an adhesiveness by the molten thermoplastic resin matrix being pressed against the external member. As used herein, the expansion stress refers to a stress generated by the expanded space filling material to the external member which enclose the space filling material.

In the method for producing a space filling material as described above, in the case where the pressure is applied to the space filling material in the thickness direction during hot pressing, the bent reinforcing fibers in the pressurized space filling material can exhibit the repulsive force in the thickness direction of the space filling material. Hence, such a space filling material expands in the thickness direction when heated, and the expansion stress occurs in the thickness direction.

In the space filling material according to the present invention, from the viewpoint of increasing the expansion stress when heated, a volume content of the reinforcing fibers each having a bent ratio of 1.004 or higher may be from 3 to 50 vol %, preferably from 5 to 45 vol %, and more preferably from 10 to 40 vol % relative to a total volume of the space filling material. The volume content of the reinforcing fibers each having a bent ratio of 1.004 or higher relative to the total volume of the space filling material indicates a proportion of the volume occupied by the reinforcing fibers each having a bent ratio of 1.004 or higher to the bulk volume of the space filling material and is a value determined by the method described in Examples below.

In the space filling material according to the present invention, from the viewpoint of increasing the expansion stress when heated, the reinforcing fibers may have an average bent ratio of 1.003 or higher, preferably 1.004 or higher, more preferably 1.005 or higher, and further preferably 1.006 or higher. The upper limit of the average bent ratio of the reinforcing fibers may be, for example, 1.05 or lower, preferably 1.04 or lower, and more preferably 1.03 or lower. The average bent ratio of the reinforcing fibers is a value determined by the method described in Examples below.

In the space filling material according to the present invention, from the viewpoint of increasing the expansion stress when heated, a weight content of the reinforcing fibers may be preferably from 15 to 60 wt %, more preferably from 18 to 55 wt %, further preferably from 20 to 50 wt %, and still more preferably from 25 to 48 wt % relative to a total weight of the space filling material. Where the weight content of the reinforcing fibers is too low, a small number of reinforcing fibers have contact with one another, so that the reinforcing fibers are less likely to be bent. On the other hand, where the weight content of the reinforcing fibers is too high, the content of the thermoplastic resin is too small to hold the reinforcing fibers in a bent state, so that it tends to be difficult to adjust the bent ratios of the reinforcing fibers.

In the space filling material according to the present invention, from the viewpoint of increasing the expansion stress when heated, a weight content of the thermoplastic resin may be preferably from 40 to 85 wt % relative to a total weight of the space filling material. The weight content may be more preferably from 45 to 82 wt %, further preferably from 50 to 80 wt %, and still more preferably from 52 to 75 wt %. Where the content of the thermoplastic resin is low, there is a possibility that the molten thermoplastic resin contributes less to adhesion, resulting in insufficient reinforcing force or fixing force. The thermoplastic resin contained in the space filling material may contain the binder component used as necessary in the production of the nonwoven fabric as the composite sheet.

In the space filling material according to the present invention, from the viewpoint of increasing expansibility and expansion stress when heated, a volume ratio of the reinforcing fibers to the thermoplastic resin (reinforcing fibers:thermoplastic resin) may be from 10:90 to 70:30. Where the proportion of the thermoplastic resin in volume base is too small relative to that of the reinforcing fibers, the space filling material expanded in a predetermined space may contact to a wall surface(s) thereof or a surface of material to be fixed at a small contact area, possibly resulting in insufficient stress contributing to strength in reinforcing the external member or strength in fixing the material to be fixed by the adhesion of the thermoplastic resin. On the other hand, where the proportion of the thermoplastic resin in volume base is too large relative to that of the reinforcing fibers, the amount of the reinforcing fibers may be insufficient, possibly resulting in insufficient expansibility. The volume ratio of the reinforcing fibers to the thermoplastic resin (reinforcing fibers:thermoplastic resin) may be preferably from 15:85 to 65:35, and more preferably from 20:80 to 60:40.

The space filling material according to the present invention may have a porosity of 0.5 to 70% in a state of before expansion or before use, from the viewpoint of increasing expansibility and expansion stress when heated. Where the space filling material which is excessively compressed has a porosity before expansion or before use of almost zero, the reinforcing fibers in such a space filling material may be broken or flow. Hence, even if the bending loads of the reinforcing fibers are released during heating, a sufficient repulsive force may not be obtained, possibly resulting in insufficient expansibility and expansion stress when heated. On the other hand, where the porosity before expansion is too high, there is little room for expansion, possibly resulting in insufficient expansibility. The porosity may be preferably from 0.8 to 68%, more preferably from 1 to 65%, and further preferably from 1 to 60% in a state of before expansion or before use. As used herein, the porosity indicates the proportion of the volume occupied by pores relative to a bulk volume of the space filling material and is a value determined by the method described in Examples below.

An average thickness of the space filling material according to the present invention can vary depending on the space to be filled and the intended use and can be selected from a wide range of, for example, from 0.01 to 20 mm. From the viewpoint of being able to be inserted into a small gap and fill the gap with high accuracy, the average thickness may be from 10 to 1000 μm, preferably from 20 to 500 μm, and more preferably from 50 to 300 μm. The average thickness of the space filling material is a value determined by the method described in Examples below.

The space filling material according to the present invention may preferably have a uniform thickness in order to facilitate insertion and make it possible to fill a gap with high accuracy, in particular, in the case where the space filling material is used in a gap with a small space (for example, a space with a thickness of from about 20 to 5000 μm). For example, a CV value of thickness may be 0.2 or less, more preferably 0.1 or less, further preferably 0.08 or less, and still more preferably 0.06 or less. The CV value of thickness of the space filling material indicates a ratio of the standard deviation to the average thickness of the measured thicknesses and is a value determined by the method described in Examples below.

An average basis weight of the space filling material according to the present invention can vary depending on the space to be filled and the intended use and can be selected from a wide range of, for example, from 10 to 10000 g/m$^2$. From the viewpoint of being able to fill even a small gap with high accuracy, the average basis weight may be from 10 to 500 g/m$^2$, preferably from 20 to 400 g/m$^2$, and more preferably from 50 to 300 g/m$^2$. The average basis weight of the space filling material is a value determined by the method described in Examples below.

The space filling material according to the present invention may have a CV value of basis weight of 0.2 or less, more preferably 0.15 or less, and further preferably 0.1 or less, from the viewpoint of being able to fill the space with high accuracy. The CV value of basis weight of the space filling material indicates a ratio of the standard deviation to the average basis weight of the measured basis weights and is a value determined by the method described in Examples below.

A density of the space filling material according to the present invention can vary depending on the space to be filled and the intended use and can be from 0.5 to 5 g/cm$^3$, preferably from 0.6 to 4 g/cm$^3$, and more preferably from 0.7 to 3 g/cm$^3$. The density of the space filling material is a value determined by the method described in Examples below.

The shape of the space filling material according to the present invention can vary depending on the space to be filled and the intended use and includes a steric shape having a three-dimensional structure. In the case of a steric shape, the direction of thermal expansion is defined as the thickness direction. From the viewpoint of being able to be inserted into a small gap and fill the gap with high accuracy, a plate-like shape is preferable.

In the space filling material according to the present invention, a release rate of the bent ratio may be 20% or higher, preferably 30% or higher, more preferably 40% or higher, further preferably 50% or higher, and still more preferably 60% or higher, the release rate of the bent ratio being defined by the following formula (2). The release rate of the bent ratio is an index indicating how large the space filling material can thermally expand. A space filling material having such a release rate of the bent ratio has an excellent strength in reinforcing a predetermined space to be filled with the space filling material and is excellent in strength for fixing a material to be fixed therewith. The upper limit of the release rate of the bent ratio is not particularly limited to a specific one and may be, for example, 100%.

$$\text{Release Rate of Bent Ratio (\%)}=[(X-1)-(Y-1)]/(X-1)\times 100 \quad (2)$$

wherein X is an average bent ratio of reinforcing fibers in a space filling material before expansion, and Y is an average bent ratio of reinforcing fibers in a space filling material after being heated to expand without pressurization (under no pressure).

The space filling material according to the present invention may preferably have a maximum expansion rate of 120% or higher, more preferably 150% or higher, further preferably 170% or higher, and still more preferably 200% or higher in the thickness direction. The upper limit of the maximum expansion rate in the thickness direction is not particularly limited to a specific one and may be 700%. Where the maximum expansion rate in the thickness direction is within the above range, sufficient strength can be obtained for reinforcement and/or fixation. The maximum expansion rate of the space filling material in the thickness direction indicates an expansion rate of the space filling material when heated to expand without applying pressure and is a value determined by the method described in Examples below.

From the viewpoint of suppressing generation of gas, the space filling material according to the present invention may be preferably substantially free of volatile substances that volatilize when heated (for example, low-molecular-weight compounds having a boiling point lower than the heating temperature), foaming agents, expansive graphite, and the like. The total amount of the volatile substances in the space filling material may be less than 0.5 wt %.

Method of Using Space Filling Material

A method of using the space filling material according to the present invention may include a step of heating the space filling material at a temperature equal to or higher than a softening point of the thermoplastic resin to expand the space filling material in a predetermined space. In the present invention, the predetermined space may be a space (gap) enclosed (surrounded) by a single external member or a space (gap) enclosed (surrounded) by a plurality of external members. Further, the space filling material may fill the whole or a part of the predetermined space.

Figure 2A:
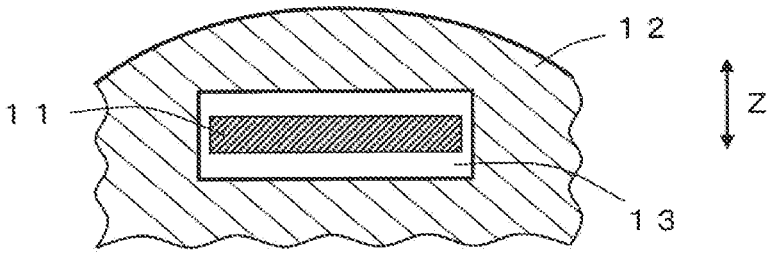
FIG. 2A is a schematic sectional view for illustrating a first embodiment of a method of using a space filling material according to the present invention, in which the space filling material is in a state before expansion.
Figure 2B:
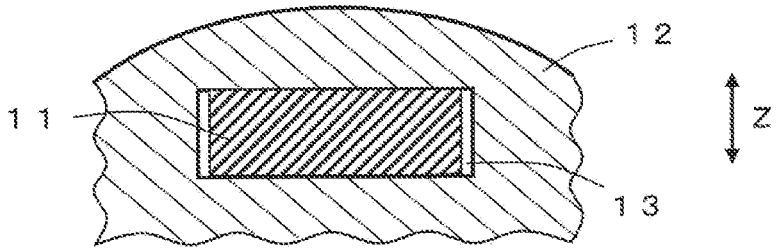
FIG. 2B is a schematic sectional view for illustrating the first embodiment of a method of using a space filling material according to the present invention, in which the space filling material is in a state after expansion.

For example, the method of using the space filling material will be described with reference to FIGS. 2A and 2B, which show schematic sectional views illustrating a first embodiment according to the present invention. FIG. 2A shows the state of the space filling material 11 before expansion, and FIG. 2B shows the state of the space filling material 11 after expansion. In FIG. 2A, the space filling material 11 is inserted into a space 13 enclosed by an external member 12. In FIG. 2A, the space 13 is defined by the single external member 12 which encloses the space entirely. However, the space does not have to be a closed space that is entirely enclosed by an external member. For example, the space may be partly open, such as in a U-shape. The space may be defined by a plurality of different members. A plurality of space filling materials 11 may be inserted into the space 13. FIG. 2A shows a part of the external member 12.

By heating the space filling material 11 at a temperature equal to or higher than the softening point of the thermoplastic resin constituting the space filling material 11, the thermoplastic resin comes to be softened, accompanied by release of the bending loads of the reinforcing fibers previously constrained by the thermoplastic resin, and thereby a repulsive force (restoring force) of the reinforcing fibers is generated in the thickness direction. Then, the space filling material 11 irreversibly expands in the thickness direction (in Z direction in FIG. 2A) to fill the space 13 as shown in FIG. 2B. A high pressing force is applied to a wall surface of the space 13 due to the expansion stress of the space filling material 11, and at the same time, the molten thermoplastic resin is pressed against and adheres to the external member 12, so that the external member 12 is sufficiently reinforced.

In the step of expanding, the heating temperature is not particularly limited to a specific one unless restriction is imposed due to heat resistance of the external member and the material to be fixed or the like. For example, relative to the softening point of the thermoplastic resin, the heating temperature may be (softening point+10)° C. or higher, preferably (softening point+30)° C. or higher, and more preferably (softening point+50)° C. or higher. The upper limit of the heating temperature may be, for example, (softening point+250)° C. or lower, and preferably (softening point+200)° C. or lower. In particular, from the viewpoint of suppressing deterioration of the thermoplastic resin, the upper limit of the heating temperature may be preferably (softening point+150)° C. or lower.

In the expansion step, although the space filling material may expand rapidly, the space filling material may expand slowly so as to have a uniform structure entirely. For example, the heating time for expansion may be from about 1 minute to 1 hour, preferably from about 10 to 50 minutes.

The method of using the space filling material according to the present invention may include a step of inserting the space filling material into the predetermined space prior to the step of expanding the space filling material.

From the viewpoint of facilitating insertion of the space filling material and filling the space with high accuracy, the thickness of the space for insertion may be from 1.01 to 4 times of the average thickness of the space filling material, preferably from 1.2 to 3.5 times, and more preferably from 1.5 to 3 times.

In the present invention, the space filling material after expansion (after filling) may have a porosity of from 30 to 95%. Where the expanded space filling material has a porosity within this range, liquid as well as air can sufficiently permeate through the expanded space filling material. For example, in the case where a structure including an expanded space filling material needs to be cooled, it is possible to cool the structure by passing a cooling liquid through the space filling material after the space is filled with the expanded space filling material. The porosity of the expanded space filling material may be preferably from 35 to 90%, and more preferably from 40 to 85%. The porosity of the space filling material after expansion is a value determined by the method described in Examples below.

In the present invention, the space filling material after expansion (after filling) may have a continuous porous structure. Where the expanded space filling material have continuous pores (voids), liquid or air can sufficiently permeate through the expanded space filling material.

In the present invention, from the viewpoint of enhancing the mechanical strength and liquid permeability of the space filling material after expansion (after filling), an expansion rate after filling in the thickness direction may be from 101 to 400%, preferably from 120% to 400%, more preferably from 130 to 300%, and further preferably from 140 to 250%. The expansion rate after filling in the thickness direction is defined by the following formula (3):

$$\text{Expansion Rate After Filling (\%)} = \text{Thickness of Space Filling Material After Filling(Thickness of Space to be Filled)(mm)/Thickness of Space Filling Material Before Filling(mm)} \times 100 \quad (3).$$

From the viewpoint of enhancing the strength in reinforcing a space and the strength in fixing a material to be fixed, a ratio of the expansion rate after filling to the maximum expansion rate, which indicates the expansion capacity of the space filling material, may be from 1 to 90%, preferably from 1.5 to 85%, and more preferably 2 to 83%, the ratio being calculated by (expansion rate after filling−100)/(maximum expansion rate−100)×100.

In the present invention, the space filling material can be expanded to obtain a desired size. A thickness of a predetermined space (a thickness of the space filling material after expansion (after filling)) can be selected from a wide range of, for example, from 0.02 to 600 mm. From the viewpoint of filling a narrow gap, the thickness may be, for example, from 20 to 5000 μm, preferably from 50 to 4000 μm, and more preferably from 80 to 3000 μm.

In the present invention, from the viewpoint of being able to fill the gap with high accuracy, a CV value of thickness of the expanded space filling material may be 0.1 or less, and preferably 0.08 or less. As used herein, the CV value of thickness of the expanded space filling material indicates the CV value of thickness of the space filling material after expansion without pressurization and is a value determined by the method described in Examples below.

In the present invention, a punching load (a load to be required for punching) described in Examples below may be 5 N or more, preferably 10 N or more, more preferably 15 N or more, and further preferably 20 N or more. The upper limit of the punching load is not particularly limited to a specific one and may be, for example, about 1000 N. The punching load is a value determined by the method described in Examples below. Where the punching load is within the above range, the space filling material can impart excellent strength in reinforcing a predetermined space to be filled with the space filling material and/or strength in fixing a material to be fixed therewith, so that the space filling material can be advantageously used as a reinforcing material or a fixing material.

The method of using the space filling material according to the present invention may further include a step of heating the space filling material at a temperature equal to or higher than the softening point of the thermoplastic resin to expand the space filling material in the predetermined space and thereby fix a material to be fixed. The space filling material according to the present invention may be used as a fixing material for fixing a material to be fixed.

Figure 3A:
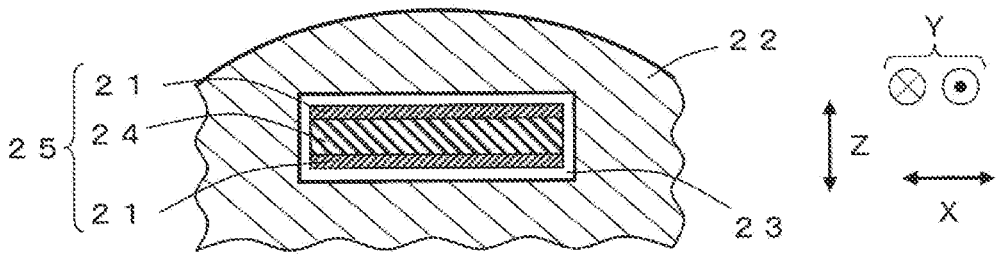
FIG. 3A is a schematic sectional view for illustrating a second embodiment of a method of using a space filling material according to the present invention, in which the space filling material is in a state before expansion.
Figure 3B:
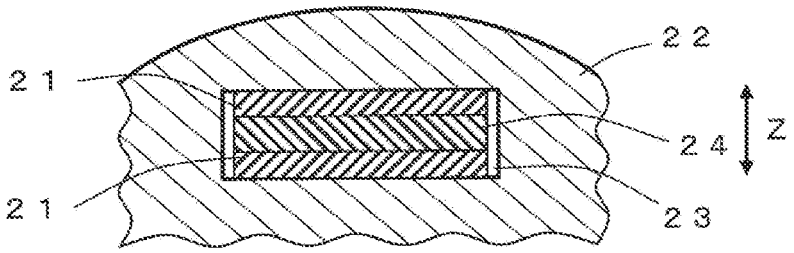
FIG. 3B is a schematic sectional view for illustrating the second embodiment of a method of using a space filling material according to the present invention, in which the space filling material is in a state after expansion being expanded.

For example, the method of using the space filling material will be described with reference to FIGS. 3A and 3B, which show schematic sectional views illustrating a second embodiment according to the present invention. FIG. 3A shows the state of the space filling material 21 before expansion, and FIG. 3B shows the state of the space filling material 21 after expansion. In FIG. 3A, a material to be fixed 24 sandwiched between two space filling materials 21 is inserted as a space filling structure 25 into a space 23 enclosed by an external member 22. In FIG. 3A, the space 23 is defined by the single external member 12 which encloses the space entirely. However, the space does not have to be a closed space that is entirely enclosed by an external member. For example, the space may be partly open, such as in a U-shape. The space may be defined by a plurality of different members. Although each of the space filling materials 21 may be disposed on each of the opposite surfaces of the material 24 to be fixed, respectively so as to be inserted, no limitation is imposed on the number of the disposed space filling materials as well as the location to be inserted. One or more sheets of the space filling materials may be disposed on at least one surface of the to-be-fixed material 24 and be inserted into the space. The space filling materials 21 disposed on the opposite surfaces of the to-be-fixed material 24 may be the same or different. From the viewpoint of enhancing the uniformity of expansibility, they may be preferably the same with each other. FIG. 3A shows a part of the external member 22.

By heating the space filling materials 21 at a temperature equal to or higher than the softening point of the thermoplastic resin constituting the space filling materials 21, the thermoplastic resin comes to be softened, accompanied by release of the bending loads of the reinforcing fibers previously constrained by the thermoplastic resin, and thereby a repulsive force (restoring force) of the reinforcing fibers is generated in the thickness direction of the space filling materials. Then, the space filling materials 21 irreversibly expand in the thickness direction (in Z direction in FIG. 3A) to fill in the space 23 together with the to-be-fixed material 24 as shown in FIG. 3B. A highly pressing force is applied to a wall surface of the space 23 and the opposite surfaces of the to-be-fixed material 24 due to the expansion stress of the space filling materials 21, and at the same time, the molten thermoplastic resin adheres to the wall surface of the space 23 and the to-be-fixed material 24 by being pressed thereon, so that the to-be-fixed material 24 is sufficiently fixed.

The method of using the space filling material according to the present invention may further include a step of inserting the space filling material and/or the material to be fixed into the predetermined space prior to the step of expanding the space filling material to fix the to-be-fixed material. The space filling material and the to-be-fixed material may be inserted together, or one of the space filling material and the to-be-fixed material may be inserted first, and then the other may be inserted. Alternatively, one of the space filling material and the to-be-fixed material may be inserted into the predetermined space into which the other has been already inserted.

Space Filling Structure

A space filling structure according to the present invention may include a space filling material(s) and a material(s) to be fixed which is integrated with the space filling material in contact with at least a part of the space filling material.

In the space filling structure, for example, the space filling material may be bonded and integrated with the material to be fixed. For example, a space filling structure in which the space filling material and the material to be fixed are bonded can be produced by: stacking the space filling material and the material to be fixed in contact with each other; and heating them at a temperature equal to or higher than the softening point of the thermoplastic resin in the space filling material while suppressing expansion of the space filling material by applying pressure or the like.

Alternatively, the space filling structure may be produced based on the method for producing the space filling material. For example, the space filling structure in which the space filling material and the material to be fixed are bonded may be produced by: stacking the composite sheet for forming the space filling material and the material to be fixed in contact with each other; heating them at a temperature equal to or higher than the softening point of the thermoplastic resin in the space filling material while applying pressure in the stacking direction; and further cooling them while applying the pressure.

Alternatively, the space filling structure can be produced, for example, by laminating the space filling material and the material to be fixed with applying an adhesive therebetween to bond them. In this case, the adhesive is not particularly limited to a specific one as long as it can bond the space filling material and the material to be fixed, and any known adhesive can be used.

In the space filling structure according to the present invention, the material to be fixed may be sandwiched between the space filling materials. In the space filling structure, the material to be fixed may be sandwiched between the space filling materials in at least two opposite directions. For example, the material to be fixed may be sandwiched between the space filling materials in the thickness direction of the to-be-fixed material, or may be sandwiched in the thickness direction of the to-be-fixed material as well as a direction(s) perpendicular to the thickness direction thereof. For example, in the case where the to-be-fixed material has a rectangular parallelepiped shape, with the thickness directions of the to-be-fixed material defined as the Z direction, the direction perpendicular to the thickness direction include: the X direction (see FIG. 3A) which is parallel to a predetermined side of the to-be-fixed material and perpendicular to the Z direction; and the Y direction (see FIG. 3A) which is perpendicular to the X direction and the Z direction. Therefore, the space filling structure may be sandwiched in four sides consisting of the opposite sides in the Z direction, i.e., the thickness directions of the to-be-fixed material, and the opposite sides in the X direction or the opposite sides in the Y direction, or be sandwiched in six sides consisting of the opposite sides in the X direction, the opposite sides in the Y direction, and the opposite sides in the Z direction. In the space filling structure, in each of the X direction, the Y direction, and the Z direction, the to-be-fixed materials may be disposed on opposite sides with respect to the space filling material, or the to-be-fixed material(s) may be disposed on only one side with respect to the space filling material.

Method of Using Space Filling Structure

A method of using the space filling structure according to the present invention may include a step of heating the space filling structure at a temperature equal to or higher than a softening point of the thermoplastic resin to make the space filling material expanded in a predetermined space so as to fix the material to be fixed.

The method of using the space filling structure according to the present invention may include a step of inserting the space filling structure into the predetermined space prior to the step of expanding the space filling material to fix the to-be-fixed material.

The space filling material according to the present invention can be effectively used as a reinforceable space filling material to reinforce an article by making a predetermined space enclosed by the article to be filled with the reinforceable space filling material, or as a fixable (fastening) space filling material to fix a material to be fixed in a predetermined space by making the predetermined space enclosed by an article to be filled with the fixable space filling material in a transportation means, a home appliance, an industrial machine, a building, or the like.

In particular, in the case where the space filling material has desired insulating properties and/or is heat resistant, an embodiment of the space filling material according to the present invention can be advantageously used as an insulating and/or heat resistant space filling material.

For example, the space filling material and the space filling structure according to the present invention can be used as a molding material for fixing permanent magnets (to-be-fixed materials) in a plurality of holes formed in a rotor of a motor (for example, a driving motor of an automobile). In such a case, the permanent magnets can be fixed with sufficient fixing strength. Further, the motor can be cooled by passing a cooling liquid through continuous pores in the space filling materials. Furthermore, the space filling materials enable to exert insulation as well. In addition, since the expanded space filling material has high fixing strength in spite that it has pores therein, the proportion of materials occupying the space can be reduced, which leads to cost reduction.

EXAMPLE

Hereinafter, the present invention will be described further in detail with reference to Examples, which are not intended to limit the present invention in any way whatsoever. In the following Examples and Comparative Examples, various physical properties were measured by the following methods.

Single Fiber Fineness

In accordance with the Method B in section 8.5.1 of JIS L 1015: 2010 "Testing methods for chemical staple fibers," a single fiber fineness was determined using an average fiber length calculated in accordance with the method described below.

Average Fiber Length

Fiber lengths of randomly selected 100 fibers were measured to calculate an average fiber length from the measured 100 values.

Average Fiber Diameter

Fiber diameters of randomly selected 30 fibers were measured by microscopic observation to calculate an average fiber diameter from the measured 30 values.

Tensile Elastic Modulus

A tensile elastic modulus was measured in accordance with JIS R 3420 in the case of glass fibers (hereinafter, sometimes abbreviated as "GF") and in accordance with JIS R 7606 in the case of carbon fibers (hereinafter, sometimes abbreviated as "CF").

Glass Transition Temperature (Tg) of Thermoplastic Fibers

Using a solid dynamic viscoelasticity analyzer "Rheospectra DVE-V4" manufactured by Rheology Co. Ltd., a temperature dependency of loss tangent (tan δ) was determined at a frequency of 10 Hz and a temperature elevation rate of 10° C./min, and a glass transition temperature of thermoplastic fibers was determined from a temperature at a peak value of tan δ. As used herein, the temperature at the peak value of tan δ means a temperature at which the first differential value of the change in the value of tan δ with respect to temperature is zero.

Volume Ratio

A volume ratio of reinforcing fibers and a thermoplastic resin that constituted a space filling material was calculated by converting a weight ratio by using each density of the reinforcing fibers and the thermoplastic resin, into the volume ratio (reinforcing fibers:thermoplastic resin).

Basis Weight

A space filling material sample having a length of 250 mm and a width of 250 mm was cut into 80 small pieces each having a length of 50 mm and a width of 15 mm. The weight (g) of each small piece was measured to calculate a basis weight (g/m$^2$). An average of the basis weights of all the small pieces was calculated as an average basis weight (g/m$^2$) of the space filling material. The standard deviation of the basis weights of all the small pieces was calculated to obtain a CV value of basis weight (basis weight CV value) by the following formula.

$$\text{Basis Weight CV Value}=\text{Standard Deviation of Basis Weights}(g/m^2)/\text{Average Basis Weight}(g/m^2)$$

Thickness

A space filling material sample having a length of 250 mm and a width of 250 mm was cut into 80 small pieces each having a length of 50 mm and a width of 15 mm. The thickness (μm) of each small piece at the center was measured using a micrometer. An average of the thicknesses of all the small pieces was calculated as an average thickness (μm) of the space filling material. The standard deviation of the thicknesses of all the small pieces was calculated to obtain a CV value of thickness (thickness CV value) by the following formula.

$$\text{Thickness CV value}=\text{Standard Deviation of Thicknesses}(\mu m)/\text{Average Thickness}(\mu m)$$

Density

A space filling material was cut to obtain a sample having a length of 50 mm and a width of 15 mm. The thickness (cm) and weight (g) of the sample was measured to calculate the density by the following formula.

$$\text{Density}(g/cm^3)=\text{Weight}(g)/(\text{Thickness}(cm)\times 7.5(cm^2))$$

Porosity

A porosity (%) of a space filling material was determined in accordance with JIS K 7075 "Testing methods for fiber content and porosity of carbon fiber reinforced plastic."

Bent Ratio

A space filling material was cut to obtain a sample having a length of 50 mm and a width of 15 mm. The sample was subjected to X-ray CT measurement under the following conditions, and obtained images were analyzed by the following procedure to measure a bent ratio.

Conditions for X-Ray CT Measurement

Measurement device: Xradia 520 Versa (manufactured by Carl Zeiss)

X-ray target: tungsten

X-ray tube voltage: 100 kV

Output: 9 W

Objective lens: 4×

Pixel size: 1 μm/pix

Binning: 1

Number of images: 3201 sheets

Exposure time: 6 seconds/sheet

Conditions for Image Analysis

Image analysis software: Avizo (manufactured by Thermo Fisher Scientific)

Three dimensional images of a space filling material sample obtained by X-ray CT measurement were cut into the size of 0.40 mm×0.40 mm×full thickness on the image analysis software. Then, noise was removed by the NON-LOCAL Filter function as needed. The NON-LOCAL Filter function was set to the following conditions.

Value of Spatial Standard Deviation: 5

Value of Intensity Standard Deviation: 0.2

Value of Search Window: 10

Value of Local Neighborhood: 3

Then, binarization was performed by the Interactive Thresholding function to extract all fibers.

To the data of the images cut into the size of 0.40 mm×0.40 mm×full thickness or the data with noise removed by NON-LOCAL Filter processing, the Fiber Tracing function was used to extract fibers each having a diameter which fit to the following setting conditions.

Value of Cylinder Length of Cylinder Correlation: any value from 2.5 to 3.5 times fiber diameter Value of Angular Sampling: 5

Value of Mask Cylinder Radius: any value between (fiber radius+1) and (fiber radius+13)

Value of Outer Cylinder Radius: fiber radius

Value of Inner Cylinder Radius: 0

Value of Direction Coefficient of Trace Correlation Lines: 0.1 to 0.5

Value of Minimum Distance: any value between fiber radius and fiber diameter

A "tortuosity" of each extracted fiber was adopted as a bent ratio. A volume content (vol %) of reinforcing fibers each having a bent ratio of 1.004 or higher relative to a total volume of all the extracted reinforcing fibers was calculated. The calculated volume content is shown as "volume content of reinforcing fibers each having bent ratio of 1.004 or higher in all reinforcing fibers" in Table 1.

A volume content (vol %) of reinforcing fibers each having a bent ratio of 1.004 or higher relative to a total volume of a space filling material was calculated by multiplying a volume content of all reinforcing fibers relative to a total volume of the space filling material, which was determined in accordance with JIS K 7075 "Testing methods for fiber content and porosity of carbon fiber reinforced plastic", by a volume content of reinforcing fibers each having the bent ratio of 1.004 or higher relative to a total volume of all reinforcing fibers. The calculated volume content is shown as "volume content of reinforcing fibers each having bent ratio of 1.004 or higher in space filling material" in Table 1.

Using the obtained data of the respective bent ratios of the fibers, an average bent ratio was calculated by the following formula.

Average Bent Ratio=Sum of Bent Ratios of Extracted Fibers/Number of Extracted Fibers Evaluation of Expansibility Space filling materials obtained in Examples and Comparative Examples were placed in a convection oven ("DN411H" manufactured by Yamato Scientific Co., Ltd.) set to a predetermined temperature equal to or higher than a softening point of a thermoplastic resin. After heating for 10 minutes, the space filling materials were taken out and cooled to 25° C. Then, the average thickness of each expanded sample was measured. A maximum expansion rate (%) was determined by the following formula from the average thickness of the sample before and after heating.

Maximum Expansion Rate (%)=Average Thickness (μm) of Space Filling Material After Expansion/Average Thickness(μm) of Space Filling Material Before Expansion×100

In the same manner as the average bent ratio of the reinforcing fibers in the space filling material as described above, an average bent ratio Y of the reinforcing fibers in the space filling material after expansion was calculated. A release rate of the bent ratio (%) was calculated by the following formula.

Release Rate of Bent Ratio (%)=$[(X-1)-(Y-1)]/(X-1)\times 100$ wherein X is an average bent ratio of reinforcing fibers in a space filling material before expansion, and Y is an average bent ratio of reinforcing fibers in a space filling material after being heated to expand without pressurization.

In the same manner as the thickness CV value of the space filling material as described above, a thickness CV value of the space filling material after expansion was calculated.

Punching Load

Figure 4A:
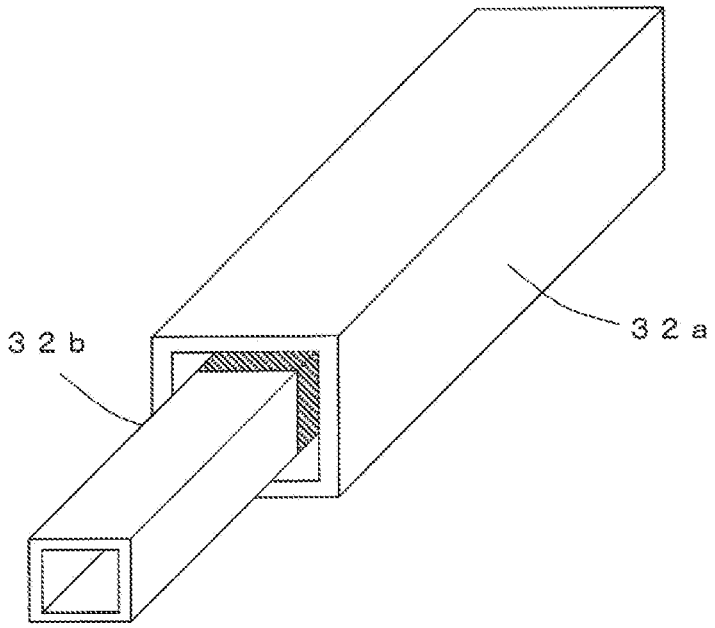
FIG. 4A is a schematic perspective view for illustrating preparation of a punching load test sample.

A punching load test sample was prepared by the following procedure. FIG. 4A is a schematic perspective view for illustrating preparation of a punching load test sample, and FIG. 4B is a schematic sectional view for illustrating preparation of a punching load test sample.

(1) Each of space filling materials obtained in Examples and Comparative Examples was cut into a length of 50 mm and a width of 15 mm to obtain a space filling material sample.

(2) Were prepared a larger hollow rectangular pipe 32*a* having a height of 20 mm, a width of 20 mm, a thickness of 2.15 mm, and a length of 100 mm, and a smaller hollow rectangular pipe 32*b* having a width of 15 mm, a thickness of 1.5 mm, and a length of 100 mm. For each of Examples and Comparative Examples, the prepared smaller hollow rectangular pipe 32*b* had such a height dimension that gaps having a predetermined height were defined between the inner horizontal surfaces of the larger hollow rectangular pipe 32*a* and the outer horizontal surfaces of the smaller hollow rectangular pipe 32*b* when the smaller hollow rectangular pipe 32*b* was inserted into the larger hollow rectangular pipe 32*a*. That is, the height dimension of the smaller hollow rectangular pipe 32*b* was adjusted to the size of inner height dimension of the larger hollow rectangular pipe 32*a* (15.7 mm)—gap height h×2.

Figure 4B:
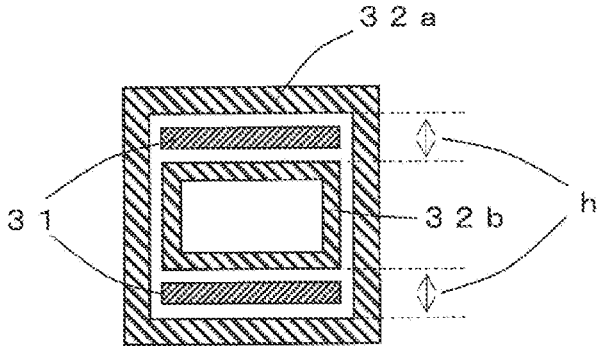
FIG. 4B is a schematic sectional view for illustrating preparation of a punching load test sample.

(3) With the smaller hollow rectangular pipe 32*b* inserted into the larger hollow rectangular pipe 32*a* by 50 mm in the length direction as shown in FIG. 4A, one space filling material sample 31 was inserted into each of the two gaps between the inner horizontal surfaces of the larger hollow rectangular pipe 32*a* and the outer horizontal surfaces of the smaller hollow rectangular pipe 32*b* as shown in FIG. 4B. The assembled body was placed in a convection oven ("DN411H" manufactured by Yamato Scientific Co., Ltd.) set to a predetermined temperature, and was heated for 20 minutes. Then, the assembled body was taken out and cooled to 25° C., so as to make the gaps filled with the space filling material samples 31.

The expansion rate after filling (%) was calculated by the following formula. In the case where a gap was occupied to the full height and completely filled, the average thickness of the space filling material after filling corresponds to the height of each gap.

Expansion Rate After Filling (%)=Average Thickness (μm) of Space Filling Material After Filling/Average Thickness(μm) of Space Filling Material Before Filling×100

In the same manner as the porosity of the space filling material as described above, a porosity (%) of the space filling material after complete filling was calculated as a porosity after filling.

For the obtained punching load test sample, a load was applied only to the smaller hollow rectangular pipe in the length direction at a compression rate of 2 mm/min using a universal testing machine ("AG-2000A" manufactured by Shimadzu Corporation) until the smaller hollow rectangular pipe was pushed out. A punching load (N) was defined as a load at which the smaller hollow rectangular pipe started to slide relative to the larger hollow rectangular pipe.

Reference Example 1 (Production of Polyetherimide Fibers)

A polyetherimide (hereafter, sometimes abbreviated as PEI) based polymer ("ULTEM9001" available from SABIC Innovative Plastics), which was an amorphous resin, was dried under vacuum at 150° C. for 12 hours. The PEI-based polymer was discharged through round-hole nozzles under the conditions of a spinning head temperature of 390° C., a spinning speed of 1500 m/min, and a discharge rate of 50 g/min to produce a multifilament (2640 dtex/1200 f) of PEI fibers. The obtained multifilament was cut to 15 mm to produce PEI shortcut fibers. The obtained fibers had good appearance without fuzz and the like and had a single fiber fineness of 2.2 dtex, an average fiber length of 15.0 mm, a glass transition temperature (a softening point of an amorphous thermoplastic resin) of 217° C., and a density of 1.27 g/cm$^3$.

Reference Example 2 (Production of PET-Based Binder Fibers)

Using a polymerization reactor, a polycondensation reaction was carried out at 280° C. by a conventional method to produce a PET-based polymer containing terephthalic acid and isophthalic acid at a copolymerization ratio (molar ratio) of 70/30 as dicarboxylic acid components, and 100 mol % of ethylene glycol as a diol component, the PET-based polymer having an intrinsic viscosity (η) of 0.81. The obtained polymer was extruded from the bottom of the polymerization reactor into water to form strands, and then was cut into pellets. The obtained PET-based polymer was fed to a vent-type co-rotating twin-screw extruder heated to 270° C. After a retention time of two minutes, the PET-based polymer was led to a spinning head heated to 280° C., discharged through round-hole nozzles under the condition of a discharge rate of 45 g/min, and wound up at a spinning speed of 1200 m/min to produce a multifilament (2640 dtex/1200 f) of the PEI-based polymer. Then, the obtained fibers were cut to 5 mm. The obtained fibers had good appearance without fuzz and the like and had a single fiber fineness of 2.2 dtex, an average fiber length of 5.0 mm, and a density of 1.38 g/cm$^3$.

Reference Example 3 (Production of Polycarbonate Fibers)

A polycarbonate (hereinafter, sometimes abbreviated as PC) based polymer ("Iupilon S-3000" available from Mitsubishi Engineering Plastics Corporation), which was an amorphous resin, was dried under vacuum at 120° C. for 6 hours. The PC-based polymer was discharged through round-hole nozzles under the conditions of a spinning head temperature of 300° C., a spinning speed of 1500 m/min, and a discharge rate of 50 g/min to produce a multifilament (2640 dtex/1200 f) of PC fibers. The obtained multifilament was cut to 15 mm to produce PC shortcut fibers. The obtained fibers had good appearance without fuzz and the like and had a single fiber fineness of 2.2 dtex, an average fiber length of 15.0 mm, a glass transition temperature (a softening point of an amorphous thermoplastic resin) of 150° C., and a specific gravity of 1.2 g/cm$^3$.

Reference Example 4 (Preparation of Thickener)

A thickener was prepared by adding 2 g of Pamol (available from Meisei Chemical Works, Ltd.) to 2 L of water and stirring until Pamol was completely dissolved.

Reference Example 5 (Preparation of Dispersant)

A solution containing 3.75 g of Alkox CP-B1 (available from Meisei Chemical Works, Ltd.) dissolved in 2 L of water, and a solution containing 3.75 g of Pulset HA (available from Meisei Chemical Works, Ltd.) dissolved in 2 L of water were prepared as dispersants, respectively. In use, 20 mL of each dispersant was added to a slurry.

Example 1

A slurry was prepared by adding 50 wt % of PEI fiber as thermoplastic fibers, 45 wt % of glass fibers (available from Nippon Electric Glass Co., Ltd.: average fiber diameter: 10.5 μm, specific gravity: 2.54 g/cm$^3$) having a cut length of 13 mm as reinforcing fibers, and 5 wt % of PET-based binder fibers as binder fibers into 1.5 L of water and 40 mL of dispersants, and stirring the mixture 1500 times at 540 rpm using a disintegrator. To the obtained slurry was added 60 to 80 mL of a thickener, and then, a mixed nonwoven fabric (mixed paper) having a basis weight of 78 g/m$^2$ was obtained by a wet-laid process.

Three sheets of the obtained mixed nonwoven fabrics were stacked, and the stacked material was heated at 340° C. for 10 minutes under pressure of 3 MPa applied to the surface perpendicular to the stacking direction using a test press machine ("KVHC-II" manufactured by Kitagawa Seiki Co., Ltd.), so that the molten PEI-based polymer and PET-based polymer were impregnated between the glass fibers. Then, with the pressure maintained, the stacked material was cooled to 150° C., i.e., a temperature equal to or lower than the glass transition temperature of the PEI-based polymer to obtain a space filling material. The obtained space filling material had an average thickness of 144 μm, a thickness CV value of 0.049, an average basis weight of 233.8 g/m$^2$, a basis weight CV value of 0.024, a density of 1.625 g/cm$^3$, and a porosity of 1.4%. A volume content of reinforcing fibers each having a bent ratio of 1.004 or higher relative to a total volume of the reinforcing fibers was 82.7 vol %.

Various evaluations were performed on the obtained space filling material. The evaluation results are shown in Table 1. In the evaluation of expansibility, the convection oven was set to a temperature of 260° C. When preparing the punching load test sample, the convection oven was set to a temperature of 280° C., and the gap height h of the punching load test sample was 300 μm.

Example 2

A space filling material was produced in the same manner as Example 1, except for using one sheet of the mixed nonwoven fabric in the process of producing the space filling material. The obtained space filling material had an average thickness of 63 μm, a thickness CV value of 0.060, an average basis weight of 81.2 g/m$^2$, a basis weight CV value of 0.024, a density of 1.293 g/cm$^3$, and a porosity of 21.5%. A volume content of reinforcing fibers each having a bent ratio of 1.004 or higher relative to a total volume of the reinforcing fibers was 81.5 vol %.

The same evaluations were performed on the obtained space filling material in the same manner as Example 1, except that the gap height h of the punching load test sample was changed to 100 μm. The evaluation results are shown in Table 1.

Example 3

A mixed nonwoven fabric was produced in the same manner as Example 1, except that neither the thickener nor the dispersants were added in the process of producing the mixed nonwoven fabric. Thereafter, a space filling material was produced in the same manner as Example 2 in the process of producing the space filling material. The obtained space filling material had an average thickness of 82 μm, a thickness CV value of 0.230, an average basis weight of 77.4 g/m$^2$, a basis weight CV value of 0.045, a density of 0.942 g/cm$^3$, and a porosity of 42.8%. A volume content of reinforcing fibers each having a bent ratio of 1.004 or higher relative to a total volume of the reinforcing fibers was 76.1 vol %.

The same evaluations were performed on the obtained space filling material in the same manner as Example 2. The evaluation results are shown in Table 1.

Example 4

A space filling material was produced in the same manner as Example 1, except for using 30 sheets of the mixed nonwoven fabrics in the process of producing the space filling material. The obtained space filling material had an average thickness of 1500 μm, a thickness CV value of 0.021, an average basis weight of 2400 g/m$^2$, a basis weight CV value of 0.018, a density of 1.600 g/cm$^3$, and a porosity of 2.9%. A volume content of reinforcing fibers each having a bent ratio of 1.004 or higher relative to a total volume of the reinforcing fibers was 83.2 vol %.

The same evaluations were performed on the obtained space filling material in the same manner as Example 1, except that the gap height h of the punching load test sample was changed to 3000 μm. The evaluation results are shown in Table 1.

Example 5

A space filling material was produced in the same manner as Example 2, except for using glass fibers (available from Nippon Electric Glass Co., Ltd.: average fiber diameter: 6.5 μm, specific gravity: 2.54 g/cm$^3$) having a cut length of 13 mm as the reinforcing fibers. The obtained space filling material had an average thickness of 62 μm, a thickness CV value of 0.038, an average basis weight of 81.0 g/m$^2$, a basis weight CV value of 0,024, a density of 1.306 g/cm$^3$, and a porosity of 20.7%. A volume content of reinforcing fibers each having a bent ratio of 1.004 or higher relative to a total volume of the reinforcing fibers was 83.0 vol %.

The same evaluations were performed on the obtained space filling material in the same manner as Example 2. The evaluation results are shown in Table 1.

Example 6

A space filling material was produced in the same manner as Example 2, except for using glass fibers (available from Nippon Electric Glass Co., Ltd.: average fiber diameter: 13 μm, specific gravity: 2.54 g/cm$^3$) having a cut length of 13 mm as the reinforcing fibers. The obtained space filling material had an average thickness of 68 μm, a thickness CV value of 0.059, an average basis weight of 79.5 g/m$^2$, a basis weight CV value of 0.031, a density of 1.169 g/cm$^3$, and a porosity of 29.0%. A volume content of reinforcing fibers each having a bent ratio of 1.004 or higher relative to a total volume of the reinforcing fibers was 81.0 vol %.

The same evaluations were performed on the obtained space filling material in the same manner as Example 2. The evaluation results are shown in Table 1.

Example 7

A space filling material was produced in the same manner as Example 1, except for preparing a slurry containing 75 wt % of PEI fibers as the thermoplastic fibers, 15 wt % of glass fibers (available from Nippon Electric Glass Co., Ltd.: average fiber diameter: 10.5 μm, specific gravity: 2.54 g/cm$^3$) having a cut length of 13 mm as the reinforcing fibers, and 5 wt % of PET-based binder fibers as the binder fibers in the process of producing the mixed nonwoven fabric. The obtained space filling material had an average thickness of 145 μm, a thickness CV value of 0.035, an average basis weight of 203.6 g/m$^2$, a basis weight CV value of 0.031, a density of 1.404 g/cm$^3$, and a porosity of 0.8%. A volume content of reinforcing fibers each having a bent ratio of 1.004 or higher relative to a total volume of the reinforcing fibers was 72.0 vol %.

The same evaluations were performed on the obtained space filling material in the same manner as Example 1. The evaluation results are shown in Table 1.

Example 8

A space filling material was produced in the same manner as Example 1, except that a spacer with a thickness of 0.3 mm was arranged during hot pressing in the process of producing the space filling material. The obtained space filling material had an average thickness of 295 μm, a thickness CV value of 0.020, an average basis weight of 245.0 g/m$^2$, a basis weight CV value of 0.020, a density of 0.831 g/cm$^3$, and a porosity of 49.5%. A volume content of reinforcing fibers each having a bent ratio of 1.004 or higher relative to a total volume of the reinforcing fibers was 38.0 vol %.

The same evaluations were performed on the obtained space filling material in the same manner as Example 1. The evaluation results are shown in Table 1.

Example 9

A space filling material was produced in the same manner as Example 1, except for preparing a slurry containing 55 wt % of PEI fibers as the thermoplastic fibers, 40 wt % of carbon fibers (available from Toho Tenax Co., Ltd.: average fiber diameter: 7 μm, specific gravity: 1.82 g/cm$^3$) having a cut length of 13 mm as the reinforcing fibers, and 5 wt % of PET-based binder fibers as the binder fibers in the process of producing the mixed nonwoven fabric. The obtained space filling material had an average thickness of 165 μm, a thickness CV value of 0.052, an average basis weight of 235.0 g/m$^2$, a basis weight CV value of 0.025, a density of 1.424 g/cm$^3$, and a porosity of 1.9%. A volume content of reinforcing fibers each having a bent ratio of 1.004 or higher relative to a total volume of the reinforcing fibers was 83.1 vol %.

The same evaluations were performed on the obtained space filling material in the same manner as Example 1. The evaluation results are shown in Table 1.

Example 10

A mixed nonwoven fabric was produced in the same manner as Example 1, except for using PC fibers as the thermoplastic fibers in the process of producing the mixed nonwoven fabric.

Three sheets of the obtained mixed nonwoven fabrics were stacked, and the stacked material was heated at 280° C. for 10 minutes under pressure of 3 MPa applied to the surface perpendicular to the stacking direction using a test press machine ("KVHC-II" manufactured by Kitagawa Seiki Co., Ltd.), so that the molten PC-based polymer and PET-based polymer were impregnated between the glass fibers. Then, with the pressure maintained, the stacked material was cooled to 130° C., i.e., a temperature equal to or lower than the glass transition temperature of the PC-based polymer to obtain a space filling material. The obtained space filling material had an average thickness of 142 μm, a thickness CV value of 0.045, an average basis weight of 221.0 g/m$^2$, a basis weight CV value of 0.023, a density of 1.556 g/cm$^3$, and a porosity of 1.9%. A volume content of reinforcing fibers each having a bent ratio of 1.004 or higher relative to a total volume of the reinforcing fibers was 79.1 vol %.

The same evaluations were performed on the obtained space filling material in the same manner as Example 1, except that in the evaluation of expansibility, the convection oven was set to a temperature of 190° C., and when preparing the punching load test sample, the convection oven was set to a temperature of 210° C. The evaluation results are shown in Table 1.

Comparative Example 1

A space filling material was produced in the same manner as Example 1, except that a spacer with a thickness of 0.5 mm was arranged during hot pressing in the process of producing the space filling material. The obtained space filling material had an average thickness of 514 μm, a thickness CV value of 0.088, an average basis weight of 231.0 g/m$^2$, a basis weight CV value of 0.030, a density of 0.449 g/cm$^3$, and a porosity of 72.7%. A volume content of reinforcing fibers each having a bent ratio of 1.004 or higher relative to a total volume of the reinforcing fibers was 119 vol %.

The same evaluations were performed on the obtained space filling material in the same manner as Example 1, except that the gap height h of the punching load test sample was changed to 600 μm. The evaluation results are shown in Table 1.

Comparative Example 2

A space filling material was produced in the same manner as Example 1, except for performing the cooling without maintaining the pressure when proceeding to the cooling step after the melting step by hot pressing in the process of producing the space filling material. The obtained space filling material had an average thickness of 485 μm, a thickness CV value of 0.075, an average basis weight of 232.0 g/m$^2$, a basis weight CV value of 0.031, a density of 0.478 g/cm$^3$, and a porosity of 71.0%.

The same evaluations were performed on the obtained space filling material in the same manner as Example 1, except that the gap height h of the punching load test sample was changed to 600 μm. The evaluation results are shown in Table 1.

Comparative Example 3

A mixed nonwoven fabric was produced in the same manner as Example 1, except for preparing a slurry containing 85 wt % of PEI fibers as the thermoplastic fibers, 10 wt % of glass fibers (available from Nippon Electric Glass Co., Ltd.: average fiber diameter: 10.5 μm, specific gravity: 2.54 g/cm$^3$) as the reinforcing fibers, and 5 wt % of PET-based binder fibers as the binder fibers in the process of producing the mixed nonwoven fabric.

One sheet of the obtained mixed nonwoven fabric was heated, with a spacer with a thickness of 70 μm arranged, at 340° C. for 10 minutes under pressure of 1 MPa applied to the surface perpendicular to the stacking direction using a test press machine ("KVHC-II" manufactured by Kitagawa Seiki Co., Ltd.), so that the molten PEI-based polymer was impregnated between the glass fibers. Then, with the pressure maintained, the heated sheet was cooled to 150° C., i.e., a temperature equal to or lower than the glass transition temperature of the PEI-based polymer to obtain a space filling material. The obtained space filling material had an average thickness of 60 μm, a thickness CV value of 0.021, an average basis weight of 80.0 g/m$^2$, a basis weight CV value of 0.021, a density of 1.333 g/cm$^3$, and a porosity of 0.7%. A volume content of reinforcing fibers each having a bent ratio of 1.004 or higher relative to a total volume of the reinforcing fibers was 18.0 vol %.

The same evaluations were performed on the obtained space filling material in the same manner as Example 2. The evaluation results are shown in Table 1.

TABLE 1

| | | | Ex. 1 | Ex. 2 | Ex. 3 | Ex. 4 | Ex. 5 | Ex. 6 | Ex. 7 |
|---|---|---|---|---|---|---|---|---|---|
| Reinforcing Fiber | Type | | GF | GF | GF | GF | GF | GF | GF |
| | Tensile Elastic Modulus | GPa | 73 | 73 | 73 | 73 | 73 | 73 | 73 |
| | Average Fiber Length | mm | 13 | 13 | 13 | 13 | 13 | 13 | 13 |
| | Density | g/cm$^3$ | 2.54 | 2.54 | 2.54 | 2.54 | 2.54 | 2.54 | 2.54 |
| | Content of Reinforcing Fiber | wt % | 45 | 45 | 45 | 45 | 45 | 45 | 20 |
| | | vol % | 29.2 | 29.2 | 29.2 | 29.2 | 29.2 | 29.2 | 11.2 |
| | Average Fiber Diameter | μm | 10.5 | 10.5 | 10.5 | 10.5 | 6.5 | 13 | 10.5 |
| | Aspect Ratio | — | 1238 | 1238 | 1238 | 1238 | 2000 | 1000 | 1238 |
| Thermoplastic Resin | Type of Thermoplastic Fiber | | PEI | PEI | PEI | PEI | PEI | PEI | PEI |
| | Softening Point (Tg) | ° C. | 217 | 217 | 217 | 217 | 217 | 217 | 217 |
| | Density of Thermoplastic Fiber | g/cm$^3$ | 1.27 | 1.27 | 1.27 | 1.27 | 1.27 | 1.27 | 1.27 |
| | Weight Content of Thermoplastic Fiber | wt % | 50 | 50 | 50 | 50 | 50 | 50 | 75 |
| | Binder Type | | PET | PET | PET | PET | PET | PET | PET |
| | Density of Binder | g/cm$^3$ | 1.38 | 1.38 | 1.38 | 1.38 | 1.38 | 1.38 | 1.38 |
| | Weight Content of Binder | wt % | 5 | 5 | 5 | 5 | 5 | 5 | 5 |
| | Density of Thermoplastic Resin | g/cm$^3$ | 1.28 | 1.28 | 1.28 | 1.28 | 1.28 | 1.28 | 1.28 |
| | Content of Thermoplastic Resin | wt % | 55 | 55 | 55 | 55 | 55 | 55 | 80 |
| | | vol % | 70.8 | 70.8 | 70.8 | 70.8 | 70.8 | 70.8 | 88.8 |
| Properties of Space Filling Material | Average Basis Weight | g/m$^2$ | 233.8 | 81.2 | 77.4 | 2400 | 81.0 | 79.5 | 203.6 |
| | Basic Weight CV Value | — | 0.024 | 0.024 | 0.045 | 0.018 | 0.024 | 0.031 | 0.031 |
| | Average Thickness | μm | 144 | 63 | 82 | 1500 | 62 | 68 | 145 |
| | Thickness CV Value | — | 0.049 | 0.060 | 0.230 | 0.021 | 0.038 | 0.059 | 0.035 |
| | Density | g/cm$^3$ | 1.625 | 1.293 | 0.942 | 1.600 | 1.306 | 1.169 | 1.404 |

TABLE 1-continued

| | | | | | | | | | |
|---|---|---|---|---|---|---|---|---|---|
| | Porosity | % | 1.4 | 21.5 | 42.8 | 2.9 | 20.7 | 29.0 | 0.8 |
| | Average Bent Ratio | — | 1.009 | 1.008 | 1.007 | 1.01 | 1.009 | 1.007 | 1.006 |
| | Volume Content of Reinforcing Fibers Each Having Bent Ratio of 1.004 or Higher in All Reinforcing Fibers | vol % | 82.7 | 81.5 | 76.1 | 83.2 | 83.0 | 81.0 | 72.0 |
| | Volume Content of Reinforcing Fibers Each Having Bent Ratio of 1.004 or Higher in Space Filling Material | vol % | 23.8 | 18.7 | 12.7 | 23.6 | 19.2 | 16.8 | 8.0 |
| Evaluation of Expansibility | Maximum Expansion Rate | % | 235 | 231 | 176 | 260 | 230 | 219 | 227 |
| | Release Rate of Bent Ratio | % | 75 | 72 | 65 | 79 | 78 | 73 | 58 |
| | Average Thickness After Expansion | μm | 338 | 145 | 145 | 3900 | 142 | 148 | 330 |
| | Thickness CV Value After Expansion | — | 0.079 | 0.067 | 0.15 | 0.035 | 0.048 | 0.059 | 0.037 |
| Evaluation of Punching Load | Gap Height | μm | 300 | 100 | 100 | 3000 | 100 | 100 | 300 |
| | Expansion Rate After Filling | % | 208 | 159 | 122 | 200 | 161 | 147 | 207 |
| | Porosity After Filling | % | 43.9 | 41.6 | 44.3 | 42.4 | 40.0 | 43.8 | 49.9 |
| | Punching Load | N | 21 | 23 | 15 | 22 | 25 | 19 | 6 |

| | | | Ex. 8 | Ex. 9 | Ex. 10 | Com. Ex. 1 | Com. Ex. 2 | Com. Ex. 3 |
|---|---|---|---|---|---|---|---|---|
| Reinforcing Fiber | Type | | GF | CF | GF | GF | GF | GF |
| | Tensile Elastic Modulus | GPa | 73 | 240 | 73 | 73 | 73 | 73 |
| | Average Fiber Length | mm | 13 | 13 | 13 | 13 | 13 | 13 |
| | Density | $g/cm^3$ | 2.54 | 1.82 | 2.54 | 2.54 | 2.54 | 2.54 |
| | Content of Reinforcing Fiber | wt % | 45 | 40 | 45 | 45 | 45 | 10 |
| | | vol % | 29.2 | 31.9 | 28.1 | 29.2 | 29.2 | 53 |
| | Average Fiber Diameter | μm | 10.5 | 7 | 10.5 | 10.5 | 10.5 | 10.5 |
| | Aspect Ratio | — | 1238 | 1857 | 1238 | 1238 | 1238 | 1238 |
| Thermoplastic Resin | Type of Thermoplastic Fiber | | PEI | PEI | PC | PEI | PEI | PEI |
| | Softening Point (Tg) | ° C. | 217 | 217 | 150 | 217 | 217 | 217 |
| | Density of Thermoplastic Fiber | $g/cm^3$ | 1.27 | 1.27 | 1.20 | 1.27 | 1.27 | 1.27 |
| | Weight Content of Thermoplastic Fiber | wt % | 50 | 55 | 50 | 50 | 50 | 85 |
| | Binder Type | | PET | PET | PET | PET | PET | PET |
| | Density of Binder | $g/cm^3$ | 1.38 | 1.38 | 1.38 | 1.38 | 1.38 | 1.38 |
| | Weight Content of Binder | wt % | 5 | 5 | 5 | 5 | 5 | 5 |
| | Density of Thermoplastic Resin | $g/cm^3$ | 1.28 | 1.28 | 1.21 | 1.28 | 1.28 | 1.28 |
| | Content of Thermoplastic Resin | wt % | 55 | 60 | 55 | 55 | 55 | 90 |
| | | vol % | 70.8 | 68.1 | 71.9 | 70.8 | 70.8 | 94.7 |
| Properties of Space Filling Material | Average Basis Weight | $g/m^2$ | 245.0 | 235.0 | 221.0 | 231.0 | 232.0 | 80.0 |
| | Basic Weight CV Value | — | 0.020 | 0.025 | 0.023 | 0.030 | 0.031 | 0.021 |
| | Average Thickness | μm | 295 | 165 | 142 | 514 | 485 | 60 |
| | Thickness CV Value | — | 0.020 | 0.052 | 0.045 | 0.088 | 0.075 | 0.021 |
| | Density | $g/cm^3$ | 0.831 | 1.424 | 1.556 | 0.449 | 0.478 | 1.333 |
| | Porosity | % | 49.5 | 1.9 | 1.9 | 72.7 | 71.0 | 0.7 |
| | Average Bent Ratio | — | 1.003 | 1.009 | 1.007 | 1.0023 | 1.0025 | 1.0035 |
| | Volume Content of Reinforcing Fibers Each Having Bent Ratio of 1.004 or Higher in All Reinforcing Fibers | vol % | 38.0 | 83.1 | 79.1 | 13.9 | 15.1 | 18.0 |
| | Volume Content of Reinforcing Fibers Each Having Bent Ratio of 1.004 or Higher in Space Filling Material | vol % | 5.6 | 26.0 | 21.8 | 1.1 | 1.3 | 0.9 |
| Evaluation of Expansibility | Maximum Expansion Rate | % | 194 | 299 | 234 | 113 | 101 | 103 |
| | Release Rate of Bent Ratio | % | 26 | 76 | 74 | 1 | 1 | 4 |
| | Average Thickness After Expansion | μm | 572 | 493 | 332 | 581 | 490 | 62 |
| | Thickness CV Value After Expansion | — | 0.030 | 0.071 | 0.075 | 0.081 | 0.078 | 0.035 |
| Evaluation of Punching Load | Gap Height | μm | 300 | 300 | 300 | 600 | 600 | 100 |
| | Expansion Rate After Filling | % | 102 | 182 | 211 | — | — | — |
| | Porosity After Filling | % | 41.2 | 40.6 | 44.4 | — | — | — |
| | Punching Load | N | 231 | 28 | 23 | 0 | 0 | 0 |

From Table 1, it can be seen that the space filling materials of Examples 1 to 10 have excellent expansibility and have values indicating high strength, i.e., punching loads of 5 N or higher in reinforcing or fixing because of the space filling materials containing a specific amount of reinforcing fibers each having a bent ratio of 1.004 or higher. Presumably because, with regard to the method of using the space filling material, filling a gap with a space filling material expanded at a relatively low expansion rate with respect to the maximum expansion rate, which indicates the expansion capacity of the space filling material, makes it possible to generate a higher expansion stress, Example 8 in which the space filling material having a maximum expansion rate of 194% is expanded at an expansion rate after filling of 102% in use can exhibit a very high strength in fixing, as shown by the punching load of 231 N.

Furthermore, the space filling materials of Examples 1, 2, and 4 to 6 have very small thickness CV values of 0.2 or less and thus have thickness CV values after expansion of 0.1 or less, so that they can fill a gap with high accuracy.

On the other hand, in Comparative Examples 1 to 3 containing 20 vol % or less of reinforcing fibers each having a bent ratio of 1.004 or higher, the space filling materials hardly expand and have very low strength in reinforcing or fixing (punching load).

INDUSTRIAL APPLICABILITY

The space filling material according to the present invention is useful for filling a predetermined space enclosed by a member in a transportation means, a home appliance, an industrial machine, a building, or the like. For example, the space filling material can be used as a reinforcing material for reinforcing a member or a fixing material for fixing a material to be fixed in a predetermined space enclosed by the member. Furthermore, the space filling material according to the present invention can be used as a molding material for fixing permanent magnets (to-be-fixed materials) in a plurality of holes formed in a rotor of a motor (for example, a driving motor of an automobile).

Although the preferred embodiments of the present invention have been described with reference to the drawings, those skilled in the art would readily arrive at various changes and modifications in view of the present specification without departing from the scope of the invention. Accordingly, such changes and modifications are included within the scope of the present invention defined by the appended claims.

REFERENCE NUMERALS

1 . . . reinforcing fibers
11, 21 . . . space filling material
12, 22 . . . external member
13, 23 . . . space
24 . . . to-be-fixed material
25 . . . space filling structure
31 . . . space filling material sample
32*a* . . . larger hollow rectangular pipe
32*b* . . . smaller hollow rectangular pipe
L . . . fiber length
$L_0$ . . . shortest distance between opposite ends of fiber
h . . . gap height

What is claimed is:

1. A space filling material, comprising:
reinforcing fibers and a thermoplastic resin,
wherein
the space filling material has a CV value of thickness of 0.2 or smaller,
the reinforcing fibers contain glass fibers,
the reinforcing fibers form a plurality of intersections, at least a part of which are bonded with the thermoplastic resin, and
among all of the reinforcing fibers, a proportion in volume of reinforcing fibers each having a bent ratio represented by the following formula (1) of 1.004 or higher is 20 vol % or more relative to a total volume of the reinforcing fibers:

$$\text{Bent Ratio}=\text{Fiber Length}/\text{Shortest Distance Between Opposite Ends of Fiber} \quad (1).$$

2. The space filling material according to claim 1, wherein the space filling material has an average thickness of from 10 to 1000 μm.

3. The space filling material according to claim 1, wherein a release rate of the bent ratio, which is defined by the following formula (2) and evaluated via expansion performed by placing the space filling material in an oven set to a predetermined temperature equal to or higher than a softening point of the thermoplastic resin, heating the space filling material for 10 minutes, and subsequently taking out the space filling material to cool to 25° C., is 20% or higher:

$$\text{Release Rate of Bent Ratio (\%)}=[(X-1)-(Y-1)]/(X-1)\times 100 \quad (2)$$

in which X is an average bent ratio of the reinforcing fibers before the expansion, and Y is an average bent ratio of the reinforcing fibers after being heated to expand without pressurization.

4. The space filling material according to claim 1, wherein the space filling material has a CV value of basis weight of 0.2 or smaller.

5. The space filling material according to claim 1, wherein the reinforcing fibers have an average fiber length of from 3 to 100 mm.

6. The space filling material according to claim 1, wherein a volume content of the reinforcing fibers each having the bent ratio of 1.004 or higher is from 3 to 50 vol % relative to a total volume of the space filling material.

7. The space filling material according to claim 1, wherein a weight content of the thermoplastic resin is from 40 to 85 wt % relative to a total weight of the space filling material.

8. The space filling material according to claim 1, wherein the space filling material has a density of from 0.5 to 5 $g/cm^3$.

9. A space filling structure, comprising: the space filling material according to claim 1, and a material to be fixed which is integrated in contact with at least a part of the space filling material.

10. A method for producing the space filling material according to claim 1, the method comprising:
preparing a composite sheet containing the reinforcing fibers and the thermoplastic resin;
heating the composite sheet at a temperature equal to or higher than a softening point of the thermoplastic resin and applying pressure to the composite sheet in a thickness direction to perform hot-pressing, thereby obtaining a hot-pressed composite sheet; and
cooling the hot-pressed composite sheet to a temperature lower than the softening point of the thermoplastic resin while applying the pressure.

11. The method according to claim 10, wherein the composite sheet is a mixed paper containing the reinforcing fibers and thermoplastic resin.

12. The method according to claim 11, wherein the mixed paper is made from an aqueous slurry containing the reinforcing fibers, the thermoplastic resin, and a dispersant.

13. The method according to claim 12, wherein the aqueous slurry further contains a thickener.

* * * * *